US005083551A

United States Patent [19]

Addison, Jr.

[11] Patent Number: 5,083,551

[45] Date of Patent: Jan. 28, 1992

[54] METHOD AND APPARATUS FOR PROVIDING IMPROVED BLOOD CIRCULATION TO A SEATED PERSON

[76] Inventor: Kenneith F. Addison, Jr., P.O. Box 27291, Tulsa, Okla. 74149

[21] Appl. No.: 112,084

[22] Filed: Oct. 26, 1987

[51] Int. Cl.[5] ..... A61H 1/00; A47C 3/00; A47C 25/00

[52] U.S. Cl. ..... 128/33; 297/284 A; 128/60

[58] Field of Search ..... 128/33, 60, 34, 54, 128/35, 36; 297/284, DIG. 4, 284; 5/211, 212; 280/43.24, 43.17-43.19, 649, 250.1; 180/907

[56] References Cited

U.S. PATENT DOCUMENTS

| | | | |
|---|---|---|---|
| 2,113,253 | 4/1938 | Gray | 128/60 |
| 2,773,498 | 12/1956 | Himmelman | 128/33 |
| 3,050,050 | 8/1962 | Kubicek | 128/33 |
| 3,196,868 | 7/1965 | Johnston | 297/284 |
| 3,298,363 | 1/1967 | Parkin | 128/33 |
| 3,492,988 | 2/1970 | Mare | 128/33 |
| 3,656,190 | 4/1972 | Regan et al. | 128/33 |
| 3,970,077 | 7/1976 | Dahl | 128/33 |
| 3,990,742 | 11/1976 | Glass et al. | 297/284 |
| 4,155,592 | 5/1979 | Tsuda et al. | 297/284 |
| 4,155,925 | 5/1979 | Tsuda et al. | 297/284 A |
| 4,469,093 | 9/1984 | Chaplar | 128/60 |
| 4,524,762 | 6/1985 | Schulman | 128/33 |
| 4,574,901 | 3/1986 | Joyner | 180/65.1 |
| 4,722,569 | 2/1988 | Morgenstern | 297/284 |

*Primary Examiner*—Edgar S. Burr
*Assistant Examiner*—Kimberly L. Asher
*Attorney, Agent, or Firm*—Shlesinger, Arkwright & Garvey

[57] ABSTRACT

A method and apparatus for providing improved blood circulation to a person seated in a wheelchair or a stationary chair used by handicapped persons, or by those who must remain inactive in a seated position for extended periods of time. The apparatus imparts an undulating, wave-like motion to the flexible seat portion of the chair which stimulates the circulation of blood in the lower extremities and prevents the development of ischaemic or decubitus ulcers by providing changing points of pressure on the buttocks and thighs of a seated individual. The apparatus is of lightweight, compact construction which may be readily applied to a conventional wheelchair or chair, and may be powered by a small storage battery mounted thereon.

20 Claims, 4 Drawing Sheets

FIG 3
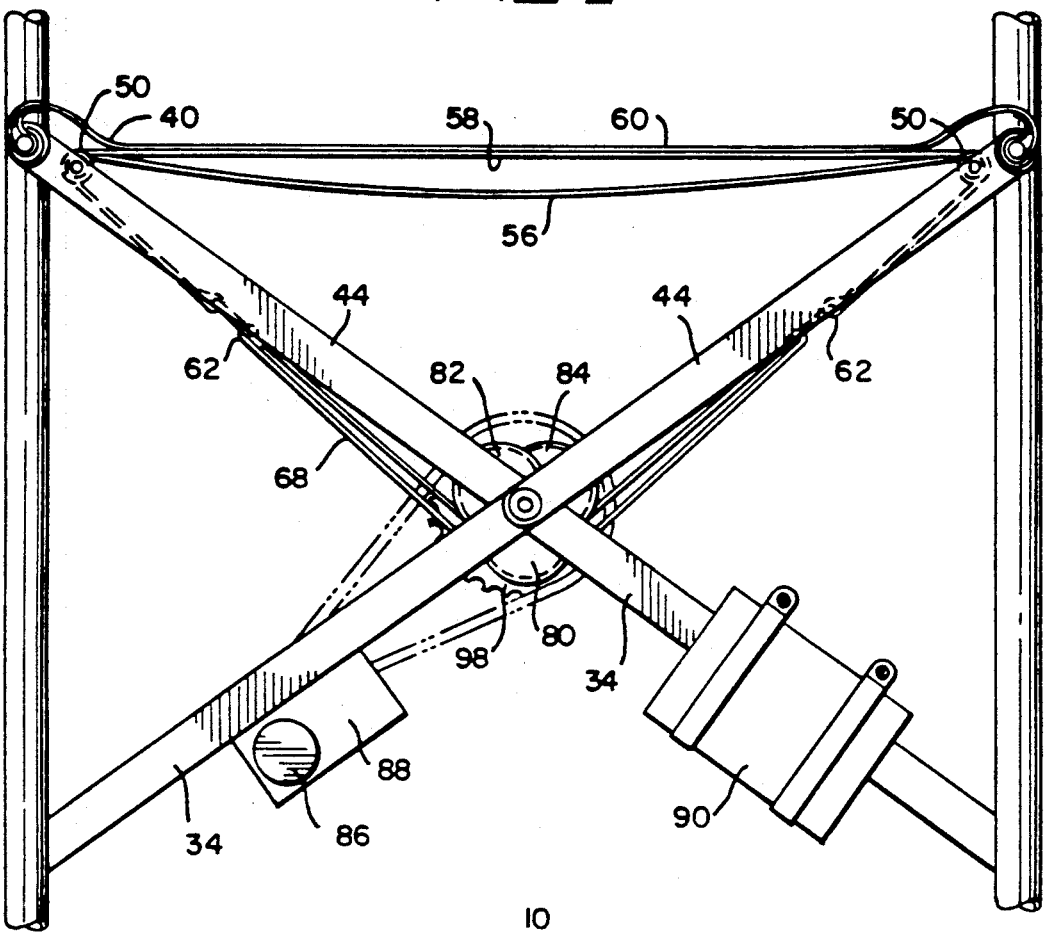
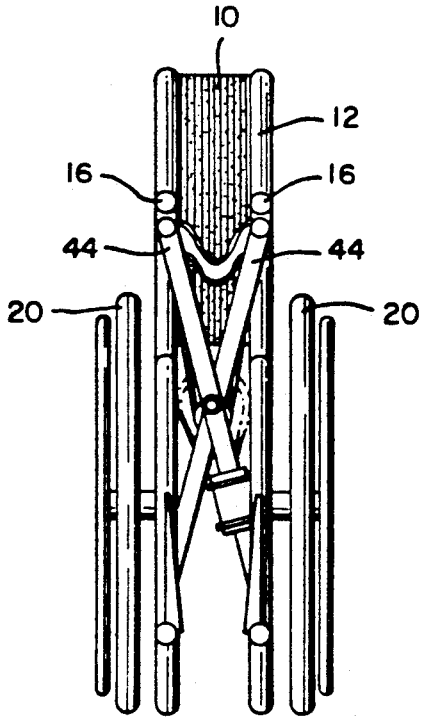
FIG 4

FIG 7
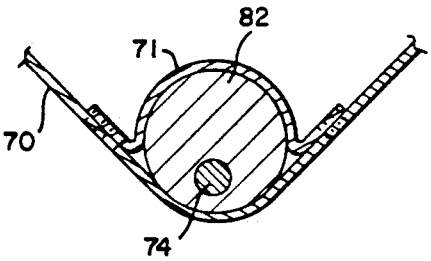
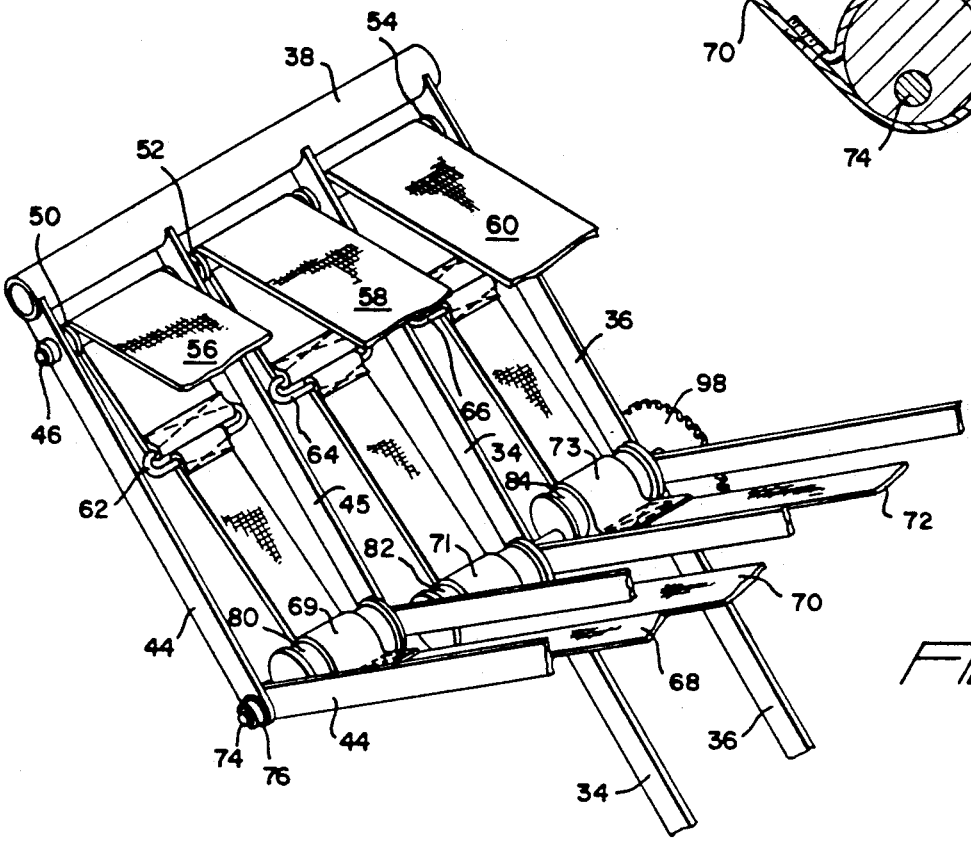
FIG 5
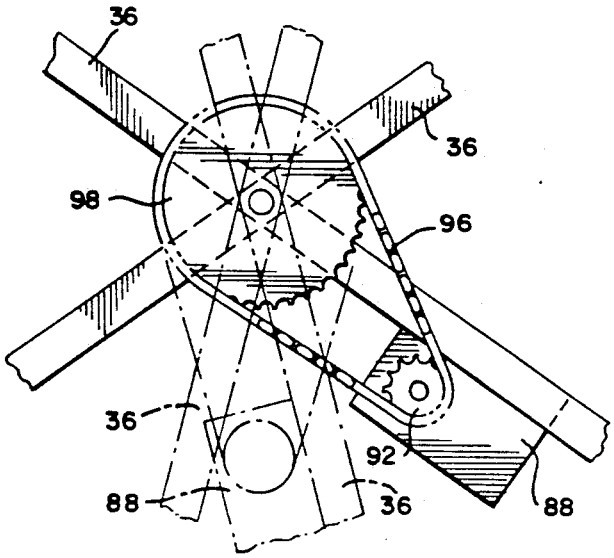
FIG 6

METHOD AND APPARATUS FOR PROVIDING IMPROVED BLOOD CIRCULATION TO A SEATED PERSON

BACKGROUND OF THE INVENTION

It is well known that individuals who are confined to wheelchairs or stationary chairs for extended periods of time are susceptible to the development of ischaemie or decubitus ulcers on their buttocks and thighs, particularly in areas where only small amounts of tissue separate bony structure from the surface of the skin. These ulcers are caused by a lack of circulation of blood in the lower extremities, and by prolonged pressure on thin tissue areas. Many months of treatment, and quite often surgery, are required to heal these ulcerations, to say nothing of the pain, the expense and the complete loss of productivity of the patient, with no assurance that the condition will not recur.

Many devices and appliances have been developed to provide relief to individuals who suffer from these ulcers.

Pernell, in U.S. Pat. No. 3,158,878, discloses a foam cushion with cut-out areas in the zones most susceptible to ulceration, and Green, In U.S. Pat. No. 4,132,228, discloses a contoured and relieved cushion. Trenchard, in U.S. Pat. No. 3,721,232, discloses a surgical pad filled with gelatinous compound, and Graves et al, in U.S. Pat. No. 3,858,379, teaches a process for making such a pad, while Panaia et al, in U.S. Pat. No. 4,493,488, discloses a varied density pad, and its installation in a conventional folding wheelchair. These cushions and pads, while providing greater comfort to a seated patient, do nothing to enhance the circulation of blood in the critical areas.

Other devices and mechanisms have addressed the problem of sustained pressure on the buttocks area, as in the case of a seated person, and over the entire body, as in the case of a person confined to a bed on a long term basis. Some of these devices and mechanisms are disclosed in U.S. Pat. Nos. 1,643,793, 2,122,702, 2,445,158, 2,448,777, 2,684,672, 2,906,259, 3,464,406, 3,467,081, 4,267,610, 4,280,487 and 4,494,260. It is noted that many of these prior art devices are cumbersome and complex, comprising a multiplicity of cams and cam followers, gears, levers, pumps, valves and compressors, rendering the apparatus unsuitable for application to a conventional wheelchair or stationary chair that is used by most handicapped persons.

Kubicek, in U.S. Pat. No. 3,050,050, discloses an alternating pressure seat comprising vertically movable slats, while Dahl, in U.S. Pat. No. 3,970,077, utilizing similar mechanisms, substitutes the use of vertically moving blocks. Schulman, in U.S. Pat. No. 4,524,762, discloses a similar device actuated by a fluid inflatable bag. More recently, Joiner, in U.S. Pat. No. 4,574,901, discloses a method of removing pressure from the buttocks of a seated individual by periodically lowering the rear section of the seat.

Tsuda et al, in U.S. Pat. No. 4,155,592, discloses a seat having a backrest provided with a plurality of belts extending transversely thereof, and electrically driven tensioning means for successively tensioning the belts to change the contour of the padding means, which provides lumbar support or massages the back of the user.

While all these examples of the prior art may provide some beneficial and/or therapeutic effect to the patient, none have directly addressed or solved the problem which is the principal causal factor in the development of decubitus ulcers, namely, lack of nourishment of body tissue, created by an insufficient supply of blood to areas where only small amounts of tissue separate bony structure from the surface of the skin, and the prolonged continuous pressure of the patient's weight upon these areas.

It is an object of this invention to provide a method for improving the blood circulation of a person seated in a chair by providing a flexible supporting surface, which flexible surface is alternately tensioned and relaxed from the front to the rear of the seat in an undulating motion, thereby stimulating the circulation of blood from the lower extremities, while, at the same time, changing the points of pressure exerted by the seat on the thighs and buttocks of the person seated in the chair.

Another object is to provide a seat for handicapped persons or persons who must remain inactive in a seated position for extended periods of time, which seat comprises a flexible surface of transversely extending straps, which produce an undulating, wave-like motion to the thighs and buttocks, and provides an action similar to that of a "progressing cavity" pump, to raise venous blood from the lower extremities and push it passed the thighs, buttocks and gluteal region, while periodically relieving the pressure imposed on those areas by the patient's weight, and allowing the blood flow to nourish and cleanse the tissue in these areas.

SUMMARY OF THE INVENTION

The present invention is a method and apparatus for providing improved blood circulation to a seated person, and particularly disabled or handicapped persons, in wheelchairs or stationary chairs, which will prevent the development of ischaemic or decubitus ulcers caused by impairment of blood circulation due to localized pressure on areas of the buttocks, where only small amounts of tissue separate bony structure from the surface of the skin, by applying a mechanically induced undulating wave motion to a flexible seating surface, to assist the venous system in raising blood from the lower extremities, the method and apparatus being also applicable to chairs for persons whose occupation demands long periods in a seated position, such as crew members on aircraft, railroad locomotive engineers and cross-country truck drivers.

The present invention basically includes a chair seat having a plurality of flexible straps extending transversely of the chair seat, and mechanism beneath the seat engageable with the straps to cause movement of the flexible straps to alternately tension the straps and then release the tension thereon, the movement of the straps being carried out in a gradual, continuous cycle from the front to the rear of the seat. This movement produces a gradual undulation of the flexible straps which causes a constant change in the pressure exerted on the thighs and buttocks, which stimulates blood flow to these areas.

The method and apparatus of the present invention also produces a constantly changing point of pressure, or absence thereof, to the buttocks of a seated individual, thereby allowing an increase in the flow of blood to the ischaemial tuberosities. The cyclic "progressing cavity" motion imparted to the seat by the apparatus also provides a pumping action which aids in the prevention of blood "pooling" in the lower extremities.

The present invention further serves as an adjunct to the cushions, pads and supports disclosed in the prior art.

It is intended that the present invention provide a therapeutic action which is incorporated, for example, in a wheelchair which: 1) contains a power source and prime mover capable of operating for extended periods of time without continuous connection to electrical means; 2) has the same physical dimensions and only slightly greater weight than chairs not so equipped; (3) may be compactly and conveniently folded for transport, and 4) incorporates an apparatus which is readily adaptable to wheelchairs in current use, to negate the requirement to purchase a special chair to avail one's self of the therapeutic benefits of the design.

DESCRIPTION OF FIGURES OF THE INVENTION

FIG. 3 is an enlarged fragmentary front elevational view thereof;

FIG. 4 is a view similar to FIG. 1, showing the wheelchair in folded position:

FIG. 5 is a fragmentary perspective view of the apparatus of the present invention;

FIG. 6 is a fragmentary elevational view of the drive means for operating the present apparatus, and FIG. 7 is a sectional view taken along the line 7—7 of FIG. 2, looking in the direction of the arrows.

DETAILED DESCRIPTION OF THE INVENTION

Figure 1:
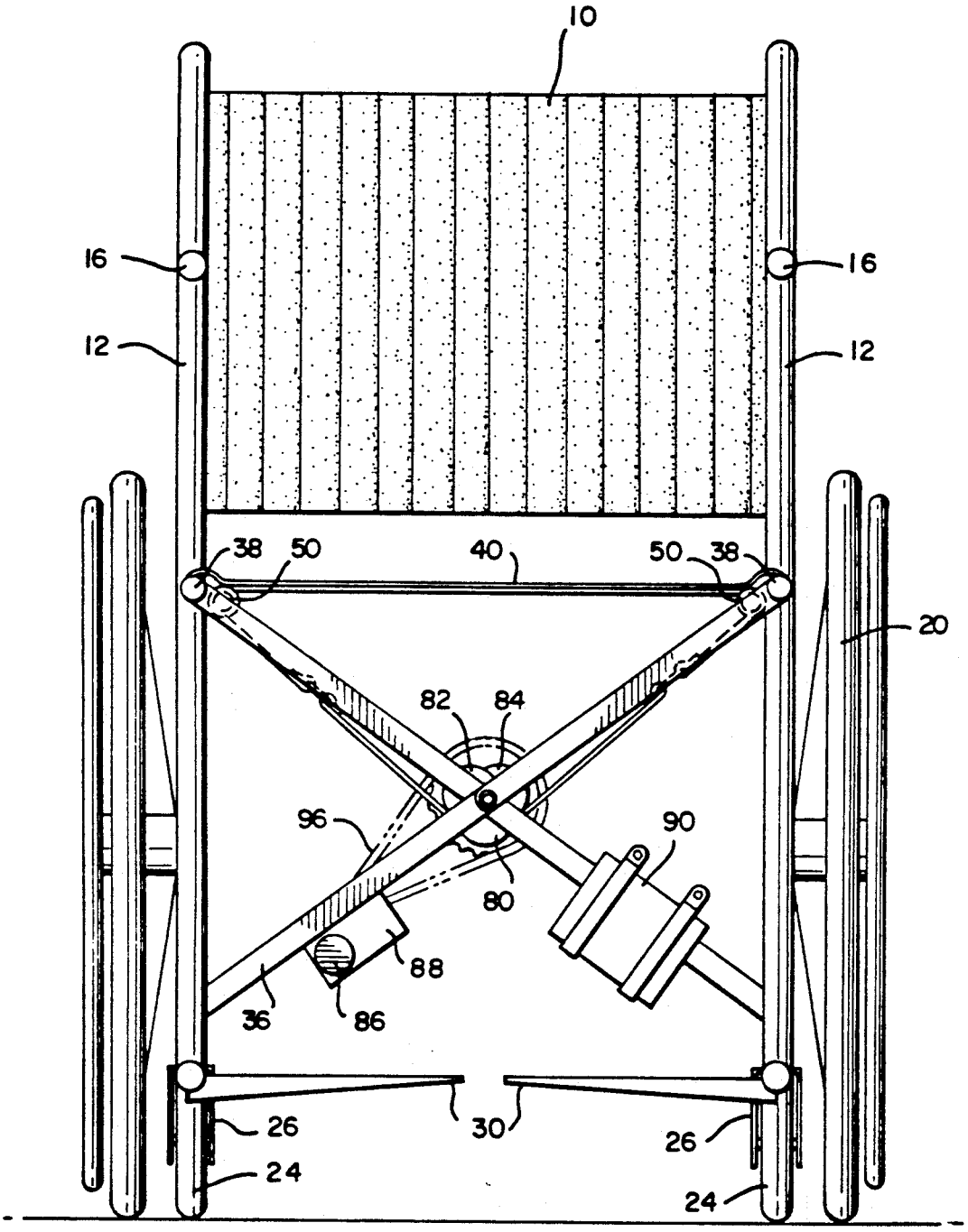
FIG. 1 is a front elevational view of a wheelchair illustrating the present invention.
Figure 2:
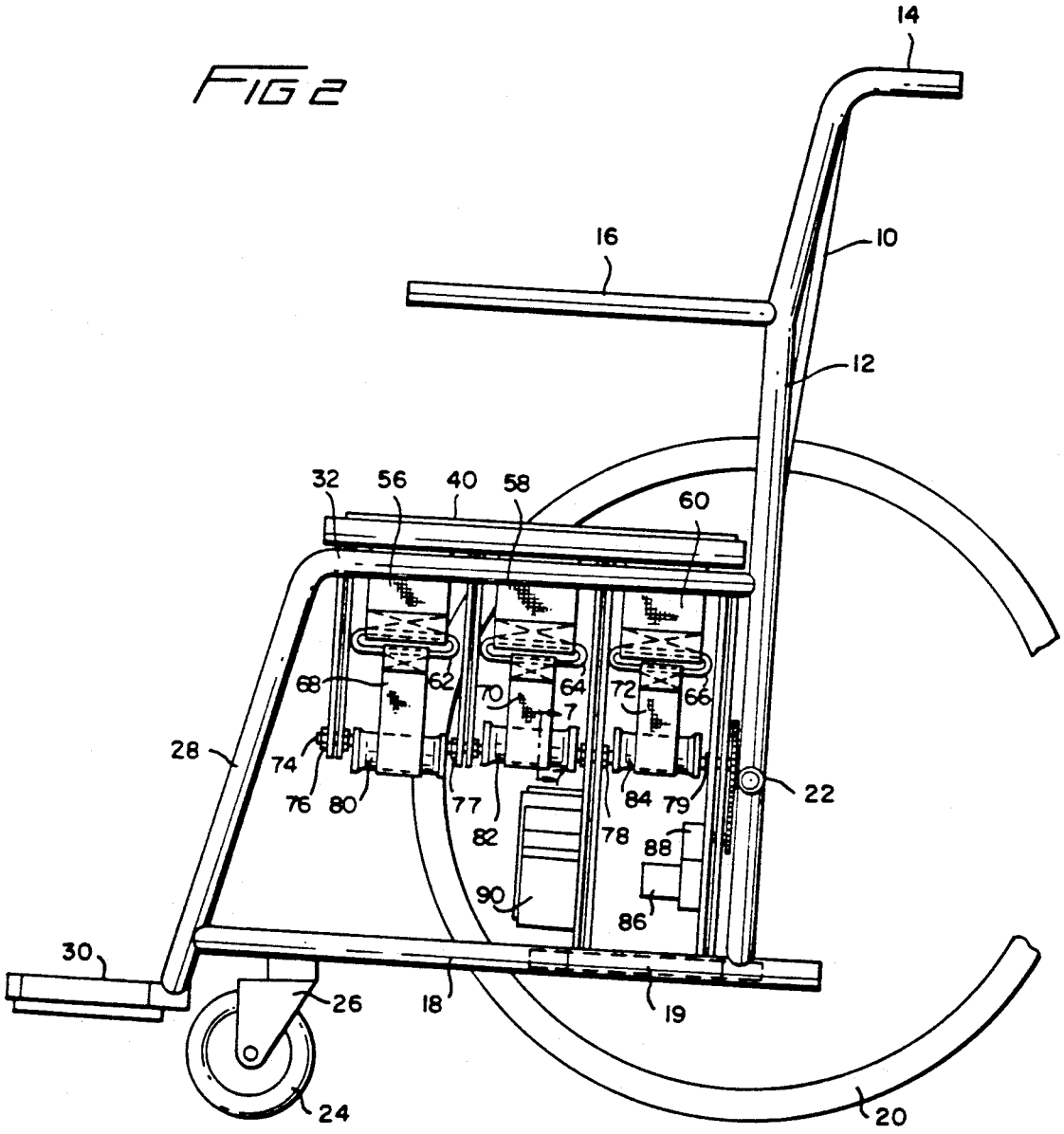
FIG. 2 is a side elevational view thereof, one of the rear wheels thereof being removed to disclose details of construction.

Referring now in greater detail to the invention, there is illustrated in FIGS. 1 and 2 a folding wheelchair which includes a backrest 10 mounted between vertical frames 12, the upper ends of which are bent to form handle bars 14. The lower ends of vertical frames 12 are connected to horizontal support bars 18 which extend forwardly of the wheelchair. Conventional folding hinges are indicated at 19. Large rear wheels 20 are rotatably connected to vertical frames 12 at 22. Small front wheels 24 are rotatably supported by brackets 26 which are secure to horizontal bars 18 and near the front end of the wheelchair.

The forward end of horizontal bars 18 are connected to the lower end of angularly disposed frames 28. Footrests 30 are secured to the lower ends of frames 28.

The upper ends of angularly disposed frames 28 are bent rearwardly to form horizontal frame portions 32 which extend to vertical frames 12.

Spaced X-shaped cross braces 34 and 36 extend upwardly from horizontal frame portions 18, the upper ends thereof being in supporting engagement with seat supports 38 which extend forwardly of vertical frames 12. A flexible seat 40 of fabric or other suitable material extends between supports 3B.

The apparatus of the present invention is generally designated 42 and, in the case of a foldable wheelchair, such as disclosed in the drawing, is adapted to be placed beneath seat 40, and will not interfere with the folding capability of the wheelchair.

Apparatus 42 includes V-shaped shaft support members 44 and 45, the upper ends of which are in engagement with the forward portion of seat support bars 38. Subjacent bars 38, there are provided a pair of shafts 46 and 48 which extend between the upper ends of V-shaped members 44 and 45 and X-shaped braces 34 and 36, and are secured thereto in any suitable manner. Pairs of idler rollers 50, 52 and 54 are rotatably mounted on shafts 46 and 48 in opposed relationship.

In accordance with the principal objects of the present invention, straps 56, 58 and 60 may be made of any suitable flexible material, such as non-stretchable fabric of the type employed for automobile seat belts.

As shown to advantage in FIGS. 1 and 3, straps 56, 58 and 60 are arranged to extend just beneath flexible surface 40 on which the individual is seated so that, when the person is seated, the straps will engage the flexible surface.

The lateral extremities of straps 56, 58 and 60 extend over idler rollers 50, 52 and 54, and then are directed downwardly into engagement with pairs of buckles 62, 64 and 66, the straps being secured to the buckle by stitching, or other suitable means. Straps 68, 70 and 72 of the same material, but narrower than straps 56, 58 and 60 extend between opposed buckles 62, 64 and 66, respectively, and are also secured thereto by stitching or other suitable means.

Apparatus 42 further includes a rotatable shaft 74 located below and centrally of the seat portion of the chair and extending fore and aft thereof, the rotatable shaft being journaled in bushings 76 and 77 connecting the lower end of V-shaped braces 44 and 45, and journaled at 78 and 79 to X-shaped braces 34 and 36 at the points where the component parts of the braces cross.

Three cylindrical spools 80,82 and 84 are eccentrically and fixedly mounted on shaft 74, as shown in FIGS. 1, 2, 3, 5 and 7, the spools being radially offset from the longitudinal axis of shaft 74, and uniformly spaced, as shown to advantage in FIGS. 1 and 3.

Flexible straps 68, 70 and 72 engage the outer periphery of eccentrically mounted spools 80, 82 and 84 so that, as shown to advantage in FIG. 2, straps 68, 70 and 72 are alternately drawn downwardly, and then upwardly, in response to the eccentric movement of the spools on which the straps are mounted.

This in turn causes a tensioning of strap 56 initially, and a relaxing of the tension on straps 58 and 60.

Upon further rotation of shaft 74, strap 58 is tensioned and the tension on straps 60 and 56 is relaxed. Finally, to complete the cycle, strap 60 is tensioned and the tension on straps 56 and 58 is relieved.

As shown in FIGS. 5 and 7, retainer straps 69, 71 and 73 are engageable with the periphery of spools 80, 82 and 84 on sides opposite to that engaged by straps 68, 70 and 72. The ends of the retainer straps are stitched or secured in any other suitable manner to straps 68, 70 and 72.

In order to effect rotation of shaft 74, there is provided a motor 86 and a reduction gear 88 which are fixedly mounted on X-shaped brace 36, which motor is driven by a conventional storage battery 90 which is electrically connected to motor 86.

As shown in FIG. 6 reduction gear 88 is connected to a drive shaft 92 having a sprocket gear 94 connected to the outer end thereof which engages a sprocket chain 96. Sprocket gear 94 extends into meshing engagement with a large sprocket gear 98 which is mounted on one end of shaft 74, for driving the latter. BY virtue of the reduction gear 88, coupled with the further speed reduction between gears 94 and 98, shaft 74 is slowly rotated so that the movement of straps 56, 58 and 60 occurs very gradually, and causes a slow undulating motion of the straps and the flexible seat 40.

When it is desired to fold the wheelchair to the folded position shown in FIG. 4, an inward and upward force is exerted on the arms of the wheelchair. This effects a pivoting motion of the components of V-shaped braces 44 and 45 and X-shaped cross braces 34 and 36 about bushings 76, 77, 78 and 79, which serve as the axis upon which the chair folds.

OPERATION

In operation, motor 86, through reduction gearing 88, sprocket gears 94 and 98 and sprocket chain 96, imparts a low speed, high torque rotation to shaft 74. This rotation is passed to the fixedly attached cylindrical eccentrics 80, 82 and 84, which are equally spaced radially, about the outward shaft. The eccentrics impart an alternating tensioning and slackening to the belts 68, 70 and 72, which is transmitted to belts 56, 58 and 60 to raise or lower that portion of flexible seat 40 which rests upon them. As the apex or lobe of each eccentric reaches the lowest point in its rotation, the corresponding belt is placed under the greatest tension, raising that portion of the flexible fabric seat which rests upon it to exert the greatest pressure on the buttocks or thighs of the occupant.

As the eccentric continues to rotate, the tension on the belt is reduced until the belt becomes completely slack as the apex or lobe of the eccentric reaches the highest point in its rotation.

As the slackening of one belt occurs, the adjacent belt comes under greater tension and exerts a greater pressure on a different area of the buttocks or thighs of the occupant. This action continues as each eccentric, in turn, raises and lowers its corresponding area of the seat in a repetitious cycle, alternately applying and relieving pressure in a continuous undulating wave-like motion.

The wave-like motion may progress from front to rear, or from rear to front, as the occupant, the physician or therapist desires, by simply reversing the polarity of motor 86. The frequency of the application and relief of pressure may be varied by changing the gear ratio between the reduction gear output shaft and the final output shaft.

Cushions and pads of various composition may be also employed to enhance the comfort of the occupant. These cushions or pads may be placed directly on fabric seat 40, or directly upon the belts, by removal of the flexible seat.

The method and apparatus of the present invention affords simple, but effective, means for providing improved blood circulation of a person seated in a wheelchair or stationary chair by providing a constant undulating movement to the portions of the body engaged with the seat, while, at the same time, providing changing points of pressure on the buttocks and thighs of the individual to prevent ulcers.

While there has herein been shown and described the presently preferred form of this invention, it is to be understood that such has been done for purposes of illustration only, and that various changes may be made therein within the scope of the appended claims.

What I claim is:

1. A method of providing improved blood circulation to the body of a person seated in a chair, comprising the steps of:

(a) providing the chair with a flexible non-stretchable supporting surface;

(b) constantly and progressively changing the tautness of the flexible supporting surface between the front and back edges thereof to produce an undulating motion of the supporting surface for assisting the venous system of the person seated in the chair in raising blood from the legs to the thighs and buttocks and to constantly change the points of pressure on the thighs and buttocks by the supporting surface.

2. The method of claim 1, wherein (a) The flexible non-stretchable supporting surface is provided by a series of straps which are successively tightened and loosened to produce an undulating motion thereof from front to rear.

3. Apparatus for attachment to a chair including:

(a) a chair seat frame having spaced lateral support members between the front and rear thereof;

(b) a plurality of body-supporting flexible straps extending transversely of said chair seat frame and engageable with said lateral support members, between the front and rear of the seat frame;

(c) movable means beyond said lateral support members and engageable with said flexible straps for assisting the venous system of the person seated in the chair in raising blood from the legs to the thigh and buttocks and to constantly change the points of pressure on the thighs and buttocks by progressively and alternatively changing the tautness of said flexible straps in a continuous operation, to produce an undulating motion of the flexible straps which is transmitted to the body;

(d) said movable means comprising a rotatable shaft connected to said frame, centrally positioned beneath the seat, and extending between the front and rear thereof;

(e) a plurality of members eccentrically fixed to said shaft and engaged by said flexible straps;

(f) said members being of cylindrical shape and provided with accentric longitudinal bores for mounting said members on said shaft;

(g) means for fixing said members to said shaft;

(h) said eccentric members being arranged to produce a progressive and successive increase, and then decrease, in the tautness of the straps for changing the pressure applied to the parts of the body contacted by the straps, and (i) power means engaged with said rotatable shaft for actuating the latter.

4. The apparatus of claim 3, wherein (a) said cylindrical members are eccentrically fixed to said shaft in spaced, radially offset relation to the longitudinal axis of said shaft.

5. The apparatus of claim 4, wherein (a) the longitudinal bores of said cylindrical members are substantially equally spaced at different points around the longitudinal axis of said rotatable shaft to successively tension the respective flexible straps engaged thereby, for producing the undulating motion of said straps.

6. The apparatus of claim 5, wherein (a) said power means comprise an electric motor having a drive shaft;

(b) means for connecting said drive shaft to said rotatable shaft, (c) a battery electrically connected to said electric motor.

7. The apparatus of claim 6, with the addition of (a) means for reducing the speed of rotation of said rotatable shaft.

8. The apparatus of claim 7, wherein (a) said means for reducing the speed of rotation of said rotatable shaft include reduction gearing operatively engaged with said electric motor.

(b) sprocket gears connected to said rotatable shaft and the drive shaft of said electric motor, and (c) a sprocket chain connecting said sprocket gears.

9. Apparatus for attachment to a chair including (a) a chair seat frame having spaced lateral support members between the front and rear thereof;

(b) pairs of opposed roller members rotatably mounted on said lateral support members;

(c) a plurality of spaced, flexible straps extending transversely of said chair seat frame, each of said straps being engaged with an opposed pair of roller members;

(d) a shaft rotatably mounted centrally and beneath said chair seat frame, and extending between the front and rear of the seat;

(e) a plurality of spaced members eccentrically fixed to said rotatably shaft, the outer periphery of each of which is engaged by one of said flexible straps;

(f) said spaced members being fixed to said shaft in spaced, radially offset relation to the longitudinal axis of said shaft, to produce a progressive and successive increase, and then decrease, in the tautness of the straps, upon rotation of the shaft for producing an undulating motion of said straps, for assisting the venous system of the person seated in the chair in raising blood from the legs to the thighs and buttocks and constantly change the points of pressure on the thighs and buttocks contacted by the flexible strap; and (g) power means engaged with said rotatable shaft for rotating the later.

10. The apparatus of claim 9, with the addition of a) a flexible seat positioned on said flexible straps.

11. The apparatus of claim 9, wherein a) said spaced members eccentrically fixed to said rotatable shaft comprises cylindrical spools.

12. The apparatus of claim 9, with the addition of a) speed reduction means engaged with said power means for reducing the speed of rotation of said rotatable shaft to effect a slow undulating movement of said flexible straps.

13. The apparatus of claim 12, wherein a) said speed reduction means includes reduction gearing operatively engaged with said electric motor.

14. The apparatus of claim 9, wherein a) said power means comprises an electric motor having a drive shaft;

b) means for connecting said drive shaft to said rotatable shaft, and c) a battery electrically connected to said electric motor.

15. A wheelchair comprising a) a flexible back portion;

b) a seat portion having spaced lateral support members connected to said back portion;

c) a mobile support frame comprising pivotally connected braces engaged with said back and seat portions for permitting folding of the wheelchair d) a plurality of body supporting flexible straps of non-stretchable material extending transversely of said seat portion and engageable with said lateral support members, said transverse straps extending between the front and rear of the seat portion;

e) a shaft centrally positioned beneath said seat portion, and extending from the front to rear thereof;

f) means engaged with said mobile support frame for rotatably supporting said shaft;

g) a plurality of cylindrical members provided with longitudinal bores for fixedly mounting the cylindrical members on said shaft in radially offset relation to the longitudinal axis of said shaft, the outer periphery of said cylindrical members being engaged by said flexible straps;

h) the longitudinal bores of said cylindrical members being equally spaced at different points around the longitudinal axis of said shaft, to successively tension the respective flexible straps engaged thereby, for producing an undulating motion of said straps; and i) power means engaged with said rotating shaft for the latter.

16. The apparatus of claim 15, wherein a) said means engaged with said mobile support frame comprises bushings with which said pivotally connected braces are engaged, said rotatable shaft being journalled in said bushings.

17. The apparatus of claim 12, wherein a) said power means comprises an electric motor having a drive shaft mounted on said mobile support frame;

b) means for connecting said drive shaft to said rotatable shaft, and c) a battery electrically connected to said electric motor.

18. The wheelchair of claim 17, with the addition of a) reduction gearing operatively engaged with said electric motor;

b) sprocket gears connected to said rotatable shaft and the drive shaft of said electric motor, and c) a sprocket chain connecting said sprocket gear.

19. The wheelchair of claim 15, wherein (a) said cylindrical members comprise a plurality of spools, said flexible straps engaging the outer periphery of said spools; and (b) means for maintaining said flexible straps in contiguous engagement with said spools.

20. The wheelchair of claim 19, wherein (a) said means comprise retainer straps in contiguous engagement with the periphery of said spools on sides opposite to that engaged by said flexible straps, (b) the ends of each of said retainer straps being secured to each of said flexible straps on opposite sides of each spool.

* * * * *